US010436205B2

(12) United States Patent
Hamano et al.

(10) Patent No.: US 10,436,205 B2
(45) Date of Patent: Oct. 8, 2019

(54) FAN MOTOR

(71) Applicant: Nidec Corporation, Kyoto (JP)

(72) Inventors: Shinsuke Hamano, Kyoto (JP); Hiroshi Miyamoto, Kyoto (JP); Jinsoo Cho, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 294 days.

(21) Appl. No.: 15/461,549

(22) Filed: Mar. 17, 2017

(65) Prior Publication Data

US 2017/0284403 A1 Oct. 5, 2017

(30) Foreign Application Priority Data

Mar. 30, 2016 (JP) ..... 2016-067583

(51) Int. Cl.

| | |
|---|---|
| ***F04D 25/06*** | (2006.01) |
| ***F04D 29/02*** | (2006.01) |
| ***F04D 29/08*** | (2006.01) |
| ***F04D 29/52*** | (2006.01) |
| ***F04D 29/64*** | (2006.01) |

(Continued)

(52) U.S. Cl.

CPC ..... *F04D 25/0693* (2013.01); *F04D 19/002* (2013.01); *F04D 29/023* (2013.01);

(Continued)

(58) Field of Classification Search

CPC .. F04D 19/002; F04D 25/0693; F04D 29/023; F04D 29/083; F04D 29/325;

(Continued)

(56) References Cited

U.S. PATENT DOCUMENTS 4,636,669 A * 1/1987 Plunkett ..... F04D 19/002 310/51
5,407,324 A * 4/1995 Starnes, Jr. ..... F04D 29/542 29/888.025

(Continued)

FOREIGN PATENT DOCUMENTS

JP 05-231385 A 9/1993
JP 11-89155 A 3/1999

(Continued)

OTHER PUBLICATIONS

Carr, McMaster. "McMaster-Carr Catalog 114." 200 New Canton Way, Robbinsville, NJ 08691-2343, 2011. pp. 782-788 (Year: 2011).*

*Primary Examiner* — Patrick Hamo
*Assistant Examiner* — Joseph S. Herrmann
(74) *Attorney, Agent, or Firm* — Keating & Bennett, LLP

(57) ABSTRACT

This fan motor includes a motor, an impeller arranged to rotate together with a rotating portion of the motor, a housing arranged to house the motor and the impeller therein, and a lead wire connected to the motor and arranged to extend outwardly of the housing. The housing includes a tubular portion, a bottom plate portion fixed below the motor, and a support portion arranged to extend from at least a portion of the tubular portion toward the bottom plate portion, and joined to at least a portion of the bottom plate portion. The support portion includes a groove portion recessed upward. The tubular portion includes a cut portion defined at a portion thereof continuous with the groove portion. The lead wire is drawn out of the housing through the groove portion and the cut portion. At least one of the groove portion and the cut portion has a thermosetting resin arranged therein.

12 Claims, 7 Drawing Sheets

(51) Int. Cl.

| | |
|---|---|
| ***F04D 19/00*** | (2006.01) |
| ***F04D 29/32*** | (2006.01) |
| ***F04D 29/38*** | (2006.01) |
| *H01B 7/02* | (2006.01) |

(52) U.S. Cl.
CPC ..... *F04D 29/083* (2013.01); *F04D 29/325* (2013.01); *F04D 29/38* (2013.01); *F04D 29/522* (2013.01); *F04D 29/646* (2013.01); *F05D 2230/41* (2013.01); *F05D 2250/294* (2013.01); *F05D 2300/44* (2013.01); *H01B 7/02* (2013.01)

(58) Field of Classification Search
CPC ..... F04D 29/38; F04D 29/522; F04D 29/646; F05D 2230/41; F05D 2250/294; F05D 2300/44; H01B 7/02
See application file for complete search history.

(56) References Cited

U.S. PATENT DOCUMENTS 6,137,197 A * 10/2000 Taniguchi ..... F04D 29/646 310/67 R
6,174,145 B1 1/2001 Taniguchi
6,359,354 B1 * 3/2002 Watanabe ..... H02K 5/08 310/154.45
6,561,762 B1 * 5/2003 Horng ..... F04D 25/0613 415/211.2
7,066,720 B2 6/2006 Cheng et al.
7,358,631 B2 * 4/2008 Morishitahara ..... F04D 25/0613 310/71
7,667,359 B2 * 2/2010 Lee ..... H02K 5/04 310/43
7,811,069 B2 10/2010 Fleig
8,007,233 B2 * 8/2011 Yang ..... F04D 25/0613 415/213.1
8,033,799 B2 10/2011 Ishikawa
8,206,104 B2 6/2012 Horng et al.
8,616,864 B2 12/2013 Nakamura et al.
9,145,896 B2 9/2015 Nakamura et al.
2007/0041857 A1 2/2007 Fleig

FOREIGN PATENT DOCUMENTS

JP 11-324994 A 11/1999
JP 2000-116098 A 4/2000

* cited by examiner

FAN MOTOR

CROSS REFERENCE TO RELATED APPLICATIONS

This application claims the benefit of priority to Japanese Patent Application No. 2016-067583 filed on Mar. 30, 2016. The entire contents of this application are hereby incorporated herein by reference.

BACKGROUND OF THE INVENTION

1. Field of the Invention

The present invention relates to a fan motor.

2. Description of the Related Art

Axial fan motors arranged to produce axial air flows by rotating impellers using driving forces of motors have been known. The axial fan motors are, for example, installed in household electrical appliances, office automation appliances, transportation equipment, and so on, and are used for the purposes of cooling electronic components, circulating gases in device cases, and so on. In addition, such fan motors are sometimes used for circulating gases in server rooms in which a large number of electronic devices are installed. A known fan motor is described in, for example, JP-A H11-089155.

The fan motor described in JP-A H11-089155 includes several spokes extending from an outer circumferential portion of a housing to a central portion thereof, and a circuit portion and so on in the central portion are held by the spokes. In addition, in this fan motor, a waterproofing agent is arranged in an area through which lead wires are drawn out from the circuit portion to one of the spokes to achieve improved waterproof performance.

As described above, for the purpose of improving waterproof performance of a fan motor, a process of pouring a thermosetting resin on an area through which a lead wire is drawn out or into a space surrounding the lead wire and curing the thermosetting resin is often performed. However, during this process, a leakage of the thermosetting resin may sometimes occur. If a leakage of the thermosetting resin occurs, a device to which the fan motor is attached may be affected, and therefore, the thermosetting resin must be removed and the process must be performed again. Moreover, a leakage of the thermosetting resin might result in an unwanted external appearance of the fan motor. There is accordingly a demand for a technique to prevent a leakage of the thermosetting resin and an unwanted external appearance of the fan motor.

Accordingly, in a process prior to the pouring of the thermosetting resin, an adhesive tape (for example, a masking tape) is often stuck to a rib or an outer frame of the fan motor, for example, to prevent a leakage of the thermosetting resin. However, it may be structurally difficult to properly seal an area through which a lead wire is drawn out on the rib or the outer frame of the fan motor with a masking tape.

SUMMARY OF THE INVENTION

A fan motor according to a preferred embodiment of the present invention includes a motor including a stationary portion and a rotating portion arranged to rotate about a rotation axis extending in a vertical direction; an impeller including a plurality of blades, and arranged to rotate together with the rotating portion; a housing arranged to house the motor and the impeller therein; and a lead wire electrically connected to the motor, and arranged to extend outwardly of the housing. The housing includes a tubular portion being tubular, and arranged to extend from an inlet side to an outlet side along the rotation axis, and house at least a portion of the impeller therein; a bottom plate portion fixed below the motor and radially inside of the tubular portion; and a support portion arranged to extend from at least a portion of the tubular portion toward the bottom plate portion, and joined to at least a portion of the bottom plate portion. The support portion includes a groove portion recessed upward. The tubular portion includes a cut portion defined at a portion thereof continuous with the groove portion. The lead wire is drawn out of the housing through the groove portion and the cut portion. At least one of the groove portion and the cut portion has a thermosetting resin arranged therein.

In the fan motor according to the above preferred embodiment of the present invention, an area in which the thermosetting resin is arranged can be easily sealed. This contributes to preventing a leakage of the thermosetting resin and an unwanted external appearance of the fan motor.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the accompanying drawings. It is assumed herein that a direction parallel to a rotation axis of a fan motor is referred to by the term "axial direction", "axial", or "axially", that directions perpendicular to the rotation axis of the fan motor are each referred to by the term "radial direction", "radial", or "radially", and that a direction along a circular arc centered on the rotation axis of the fan motor is referred to by the term "circumferential direction", "circumferential", or "circumferentially".

It is also assumed herein that, with respect to an axial direction, a side from which air is taken in (i.e., an upper side in FIG. 1) will be referred to as an "inlet side" or simply as an "upper side", and a side toward which the air is discharged (i.e., a lower side in FIG. 1) will be referred to as an "outlet side" or simply as a "lower side". Note that the above definitions of the "upper side" and the "lower side" are made simply for the sake of convenience in description, and have no relation to the direction of gravity. Fan motors according to preferred embodiments of the present invention may be used in any orientation.

Figure 1:
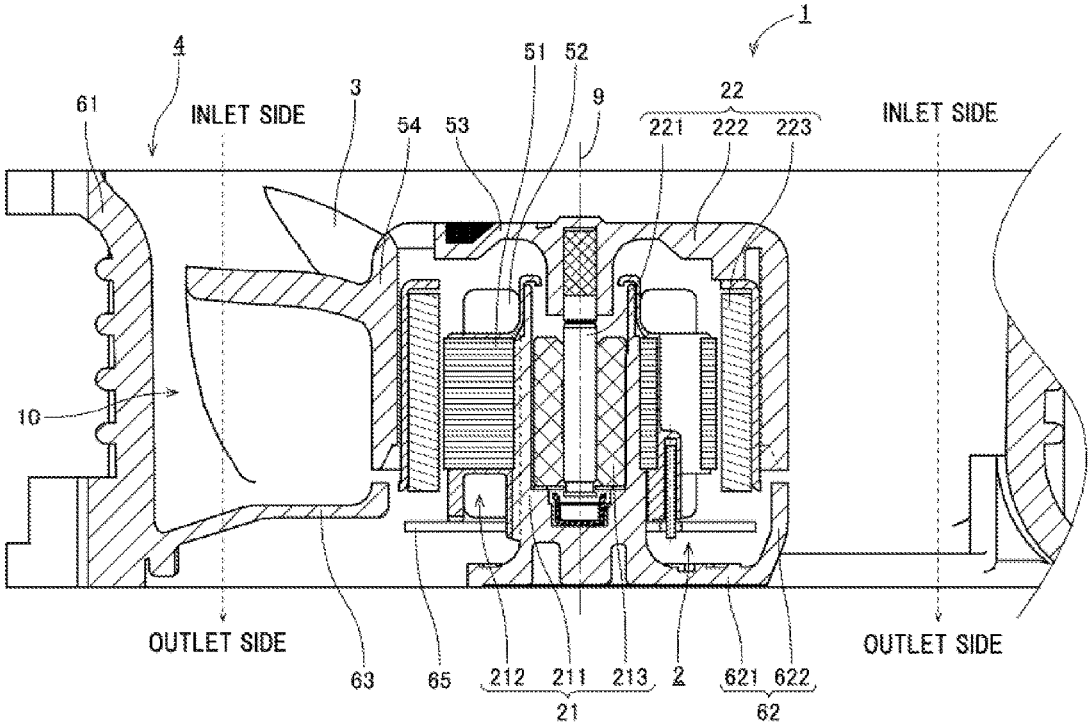
FIG. 1 is a vertical sectional view of a fan motor according to a preferred embodiment of the present invention.

FIG. 1 is a vertical sectional view of a fan motor 1 according to a preferred embodiment of the present invention.

The fan motor 1 is used, for example, as an apparatus that supplies a cooling air flow to a household electrical appliance, such as a refrigerator, or an interior of a room, such as a server room, in which a plurality of electronic devices are installed. The fan motor 1 may be used singly, or alternatively, a plurality of fan motors 1 may be used at the same time in combination. For example, a plurality of fan motors 1 may be installed in a single server room, and these fan motors 1 may be driven at the same time.

Referring to FIG. 1, the fan motor 1 includes a motor 2, an impeller 3, and a housing 4. The fan motor 1 is an axial fan arranged to produce a downward air flow along a rotation axis 9. Once the fan motor 1 is driven, air is taken in from the upper side of the fan motor 1, i.e., from the inlet side, and the air is sent to the lower side of the fan motor 1, i.e., to the outlet side, through a wind channel 10.

The motor 2 includes a stationary portion 21 and a rotating portion 22. The rotating portion 22 is supported to be rotatable with respect to the stationary portion 21. In addition, the rotating portion 22 is arranged to rotate about the rotation axis 9, which extends in a vertical direction.

The stationary portion 21 includes a base portion 211, a stator 212, and a bearing member 213. The base portion 211 is arranged to extend along the rotation axis 9 to assume a cylindrical shape. The stator 212 is an armature fixed to an outer circumferential surface of the base portion 211. The stator 212 includes a stator core 51 and a plurality of coils 52. The stator core 51 includes a plurality of teeth arranged to extend radially. Each of the coils 52 is defined by a conducting wire wound around a separate one of the teeth.

The bearing member 213 is a cylindrical member arranged radially inside of the base portion 211. The bearing member 213 is fixed to an inner circumferential surface of the base portion 211 through, for example, an adhesive. A lower portion of a shaft 221, which will be described below, is inserted radially inside of the bearing member 213. A lubricating oil is arranged between an inner circumferential surface of the bearing member 213 and an outer circumferential surface of the shaft 221. The shaft 221 is thus supported to be rotatable with respect to the stationary portion 21. Note, however, that the motor 2 may alternatively include a bearing mechanism of another type, such as, for example, a ball bearing, in place of the bearing member 213.

The rotating portion 22 includes the shaft 221, a rotor holder 222, and a magnet 223. The shaft 221 is a columnar member arranged to extend along the rotation axis 9. The shaft 221 is rotatably supported by the base portion 211 through the bearing member 213. An upper end portion of the shaft 221 is arranged to project upward above the bearing member 213. While the motor 2 is running, the shaft 221 rotates about the rotation axis 9.

The rotor holder 222 is a member in the shape of a covered cylinder, including a disk-shaped rotor cover portion 53 arranged to extend substantially perpendicularly to the rotation axis 9, and a rotor tubular portion 54 arranged to extend from the rotor cover portion 53 to the outlet side. A metal or a resin, for example, is used as a material of the rotor holder 222. A central portion of the rotor cover portion 53 is fixed to the upper end portion of the shaft 221. The rotor holder 222 is thus arranged to rotate together with the shaft 221. The rotor cover portion 53 is arranged on the inlet side of the stationary portion 21. The rotor tubular portion 54 is arranged radially outside of the stator 212.

The impeller 3 includes a plurality of blades. An inner end portion of each blade is joined to the rotor tubular portion 54. That is, each blade is arranged to extend radially outward from a junction of the blade with the rotor tubular portion 54. The impeller 3 is arranged to rotate together with the shaft 221 and the rotor holder 222 of the rotating portion 22. The blades are arranged at substantially regular intervals in a circumferential direction. Note that the number of blades is not limited to particular values.

Figure 2:
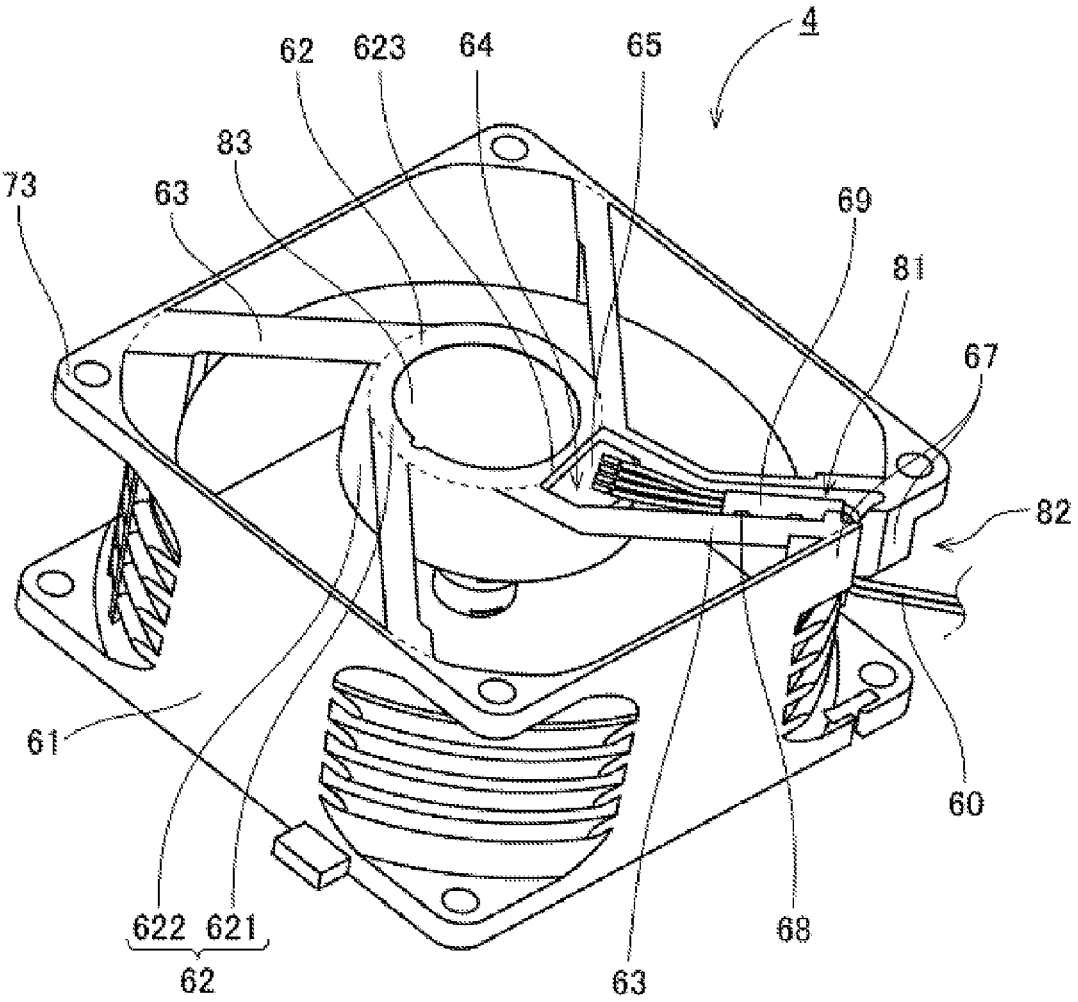
FIG. 2 is a perspective view of a housing according to a preferred embodiment of the present invention.
Figure 3:
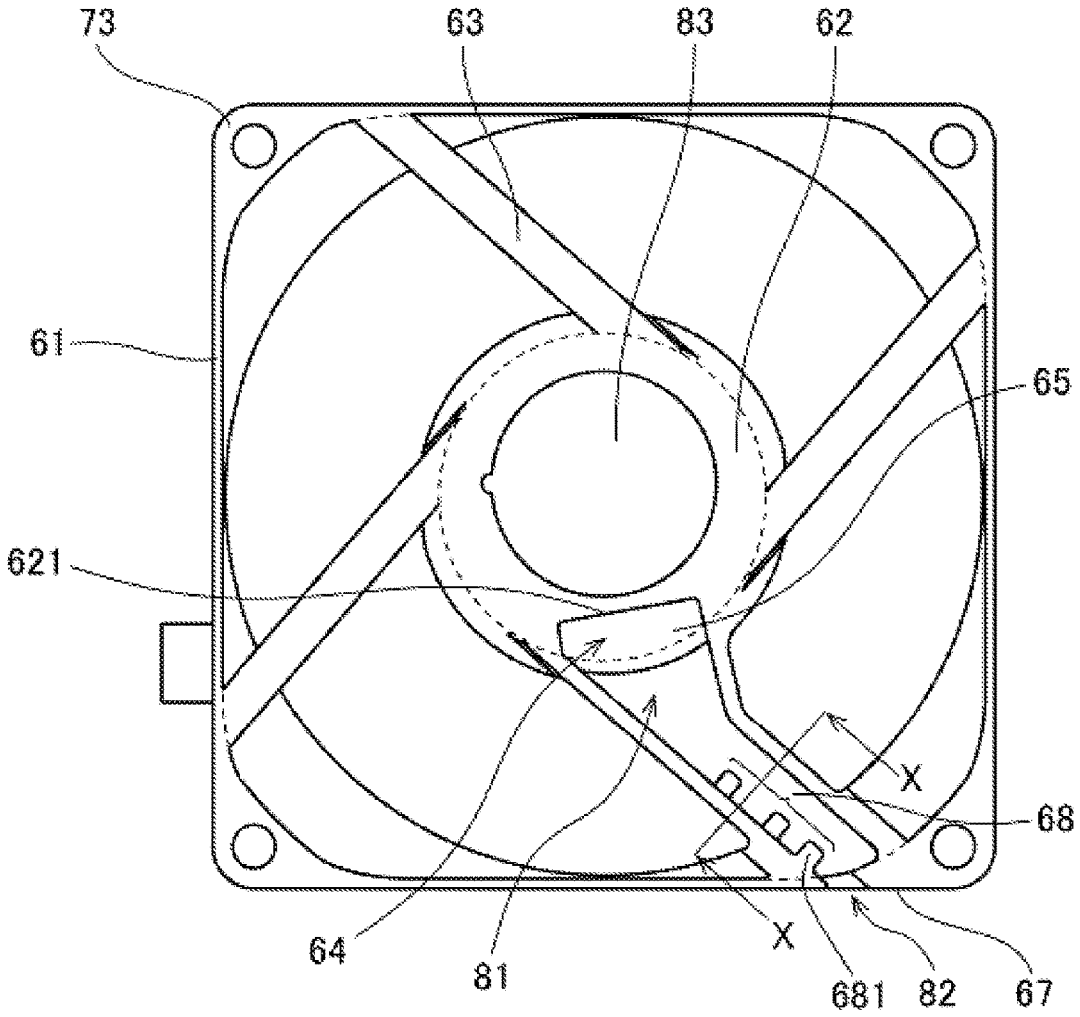
FIG. 3 is a bottom view of the housing according to a preferred embodiment of the present invention.

The housing 4 is a case arranged to house the motor 2 and the impeller 3 therein. FIG. 2 is a perspective view of the housing 4 as viewed obliquely from below. FIG. 3 is a bottom view of the housing 4. Referring to FIGS. 1 to 3, the housing 4 includes a tubular portion 61, a bottom plate portion 62, and a plurality of support portions (ribs) 63.

The tubular portion 61 is tubular and is arranged to extend from the inlet side (i.e., the upper side) to the outlet side (i.e., the lower side) along the rotation axis 9. The tubular portion 61 is arranged to extend radially outside of the impeller 3 to substantially assume a cylindrical shape. The tubular portion 61 is arranged to house at least a portion of the impeller 3 therein. That is, the tubular portion 61 is arranged in an annular shape radially outside of the impeller 3 to surround the impeller 3.

The housing 4 includes the bottom plate portion 62, which is fixed below the motor 2 and radially inside of the tubular portion 61. The bottom plate portion 62 is arranged radially inside of the tubular portion 61 and below the stator 212. Referring to FIGS. 1 and 2, the bottom plate portion 62 includes a disk-shaped portion 621 and a circumferential wall portion 622. The disk-shaped portion 621 is arranged to extend substantially perpendicularly to the rotation axis 9. The circumferential wall portion 622 is arranged to extend upward from an outer circumferential portion of the disk-shaped portion 621 to assume a tubular shape. A lower end portion of the base portion 211 of the motor 2 is fixed to the disk-shaped portion 621. In the present preferred embodiment, the base portion 211 and the bottom plate portion 62 are defined by a single continuous monolithic member. Note, however, that the base portion 211 and the bottom plate portion 62 may alternatively be defined by separate members.

Referring to FIG. 2, the housing 4 includes the plurality of support portions 63. Each support portion 63 is arranged to extend from at least a portion of an inner surface of the tubular portion 61 toward the bottom plate portion 62, and is joined to at least a portion of the bottom plate portion 62. The stationary portion 21 of the motor 2 is thus positioned with respect to the housing 4. In the present preferred embodiment, the number of support portions 63 is four. Note, however, that the number of support portions 63 may alternatively be one, two, three, or more than four.

The support portions 63 are arranged at regular intervals in the circumferential direction around the bottom plate portion 62. Each support portion 63 is arranged to extend in a straight line perpendicularly to the axial direction. Referring to FIG. 2, each support portion 63 according to the present preferred embodiment is arranged to extend along a tangent to a circular outer circumference of the bottom plate portion 62. Note, however, that each support portion 63 may not necessarily be arranged to extend along the tangent to the outer circumference of the bottom plate portion 62. Each support portion 63 may alternatively be arranged to extend in a radial direction.

As indicated by broken lines in FIGS. 2 and 3, it is assumed that each support portion 63 extends from the circular outer circumference of the bottom plate portion 62 to an inner circumference of the tubular portion 61 in the present preferred embodiment. The bottom plate portion 62 and each support portion 63 are smoothly joined to each other, and are defined integrally with each other. Further, each support portion 63 and the tubular portion 61 are smoothly joined to each other, and are defined integrally with each other. Specifically, the tubular portion 61, the bottom plate portion 62, and the support portions 63 are defined in one piece by a resin injection molding process. Note, however, that any two or more of the tubular portion 61, the bottom plate portion 62, and the support portions 63 may alternatively be defined by separate members.

At both an upper end and a lower end of the tubular portion 61, the housing 4 includes a plurality of flange portions 73 each of which is arranged to project radially outward. In the present preferred embodiment, at each of the upper and lower ends of the tubular portion 61, four of the flange portions 73 are arranged at regular intervals in the circumferential direction. When the fan motor 1 is used, the flange portions 73 are fixed to a frame of a household electrical appliance or the like through screws. Note, however, that the flange portions 73 may not necessarily be provided in the housing 4. Also note that the flange portions 73 may alternatively be provided at only one of the upper and lower ends of the tubular portion 61.

Next, the structure of a portion of the fan motor 1 at which a thermosetting resin 20 is arranged will now be described below. Lead wires 60 are shown in FIG. 2.

Referring to FIG. 2, at least one of the four support portions 63 is wider than the other support portions 63, and includes a groove portion 81 recessed upward (i.e., to the side on which the motor 2 is disposed). The groove portion 81 is arranged to extend along a longitudinal direction of the support portion 63. In addition, at a lower surface of the tubular portion 61, a cut portion 82 is defined at a portion of the tubular portion 61 which is continuous with the groove portion 81, more specifically, a portion of the tubular portion 61 which is continuous with the groove portion 81 on a radially outward extension of the support portion 63 along the longitudinal direction thereof.

The cut portion 82 is defined by cutting a portion of the tubular portion 61 substantially in a radial direction. Note that this cutting is done slightly obliquely with respect to the radial direction, in a direction parallel to the longitudinal direction of the support portion 63. Further, the tubular portion 61 includes restricting portions 67 in the vicinity of the cut portion 82. A radially outer surface of each restricting portion 67 is arranged to have a sufficient area to allow a masking tape 30 to be stuck thereto. The restricting portions 67 are arranged to extend in the axial direction on both circumferential sides of the cut portion 82. Each restricting portion 67 is arranged to have an axial dimension greater than that of each flange portion 73, allowing the masking tape 30 to be easily stuck thereto.

As described above, at least a portion of a lower surface of each of the support portions 63 is smoothly and continuously joined to each of at least a portion of the lower surface of the tubular portion 61 and at least a portion of a lower surface of the bottom plate portion 62 in a radial direction. This makes it possible to easily cover at least a portion of the lower surface of each support portion 63, at least a portion of the lower surface of the tubular portion 61, and at least a portion of the lower surface of the bottom plate portion 62 with the masking tape 30 without a gap. A leakage of the thermosetting resin 20, which will be described below, can thus be prevented.

Further, the bottom plate portion 62 includes a recessed portion 83 defined in at least a portion of the lower surface thereof. A nameplate or the like is typically installed in the recessed portion 83. The recessed portion 83 prevents a shoulder from being defined due to the thickness of the nameplate when the nameplate is stuck to the bottom plate portion 62.

Furthermore, an end portion 623 of the bottom plate portion 62 at a junction of the bottom plate portion 62 with the support portion 63 including the groove portion 81 is spaced from the recessed portion 83 so as not to overlap with the recessed portion 83. This spacing facilitates an operation of sticking the masking tape 30 to the bottom plate portion 62 in preparation for pouring of the thermosetting resin 20.

As illustrated in FIGS. 2 and 3, an opening portion 64 is defined in the vicinity of the junction of the bottom plate portion 62 with the support portion 63. In addition, at least a portion of a circuit board 65, which is arranged in a lower portion of the motor 2, is exposed outwardly through the opening portion 64 on the lower side of the fan motor 1.

Each lead wire 60 is electrically connected to the circuit board 65 of the motor 2. The lead wire 60 is arranged to pass through the opening portion 64 on the axially lower side, be accommodated in the groove portion 81 of the support portion 63, and extend radially outward along the groove portion 81. The lead wire 60 is arranged to pass through the groove portion 81 and the cut portion 82, and is drawn out of the housing 4, that is, out of the fan motor 1. The groove portion 81 is arranged to have sufficient depth and width to allow the lead wires 60 to be accommodated therein.

Figure 4:
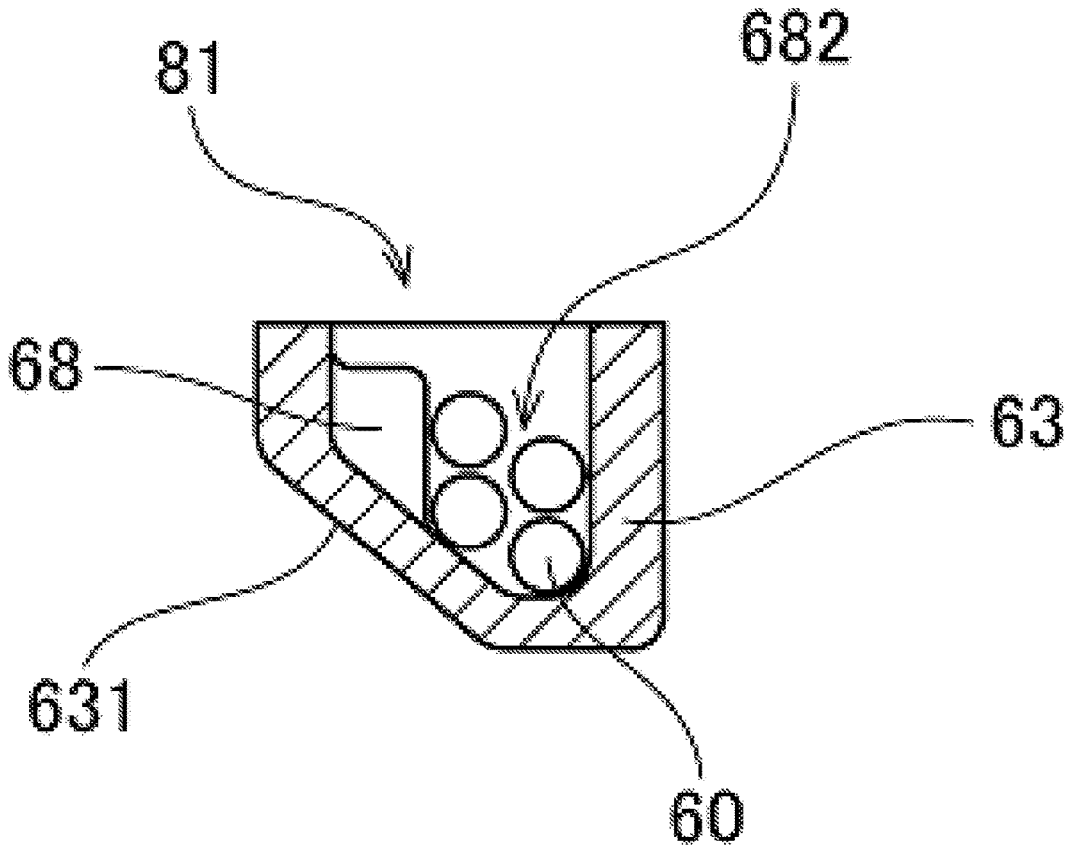
FIG. 4 is a vertical sectional view of a support portion according to a preferred embodiment of the present invention.

FIG. 4 is a sectional view of the support portion 63 taken along line X-X in FIG. 3. As illustrated in FIGS. 3 and 4, the support portion 63 includes a plurality of projecting portions 68. Each of the projecting portions 68 is arranged to project in a direction that crosses the longitudinal direction of the support portion 63 in the groove portion 81. Each lead wire 60 is accommodated in a space 682 to the side of the projecting portions 68 in the groove portion 81. That is, the projecting portions 68 are arranged to hold the lead wires 60 accommodated in the groove portion 81 at a plurality of positions to prevent the lead wires 60 from protruding from a surface of the thermosetting resin 20 and downward out of the groove portion 81.

Referring to FIG. 4, the support portion 63 includes a tapered surface 631 which is angled with respect to both the axial and circumferential directions. The direction of an air flow passing through the wind channel 10 can thus be adjusted to achieve improved characteristics of the fan motor 1. Moreover, noise caused by rotation of the fan motor 1 can thus be minimized.

As described below, the thermosetting resin 20 is arranged to extend from a radially innermost end of the groove portion 81 in the vicinity of a junction of the groove portion with the bottom plate portion 62 to a position radially outward of a projecting portion 681, which is the radially outermost one of the projecting portions 68, in the vicinity of a junction of the groove portion 81 with the tubular portion 61. In the present preferred embodiment, the projecting portion 681, which is the radially outermost one of the projecting portions 68, is arranged to have the greatest axial dimension of all the projecting portions 68. Radially outward spreading of the thermosetting resin 20 and an inflow of the thermosetting resin 20 can thus be controlled.

At least portions of the lead wires 60 which are accommodated in the space to the side of the projecting portions 68 in the groove portion 81 are preferably coated with a heat-shrinkable tube 69 made of, for example, a polyester resin. In this case, the heat-shrinkable tube 69, which bundles the lead wires 60, is caught by the projecting portions 68. This contributes to preventing the lead wires 60 from rising. Moreover, the heat-shrinkable tube 69 serves as a barrier to more effectively prevent a leakage of the thermosetting resin 20.

Figure 5:
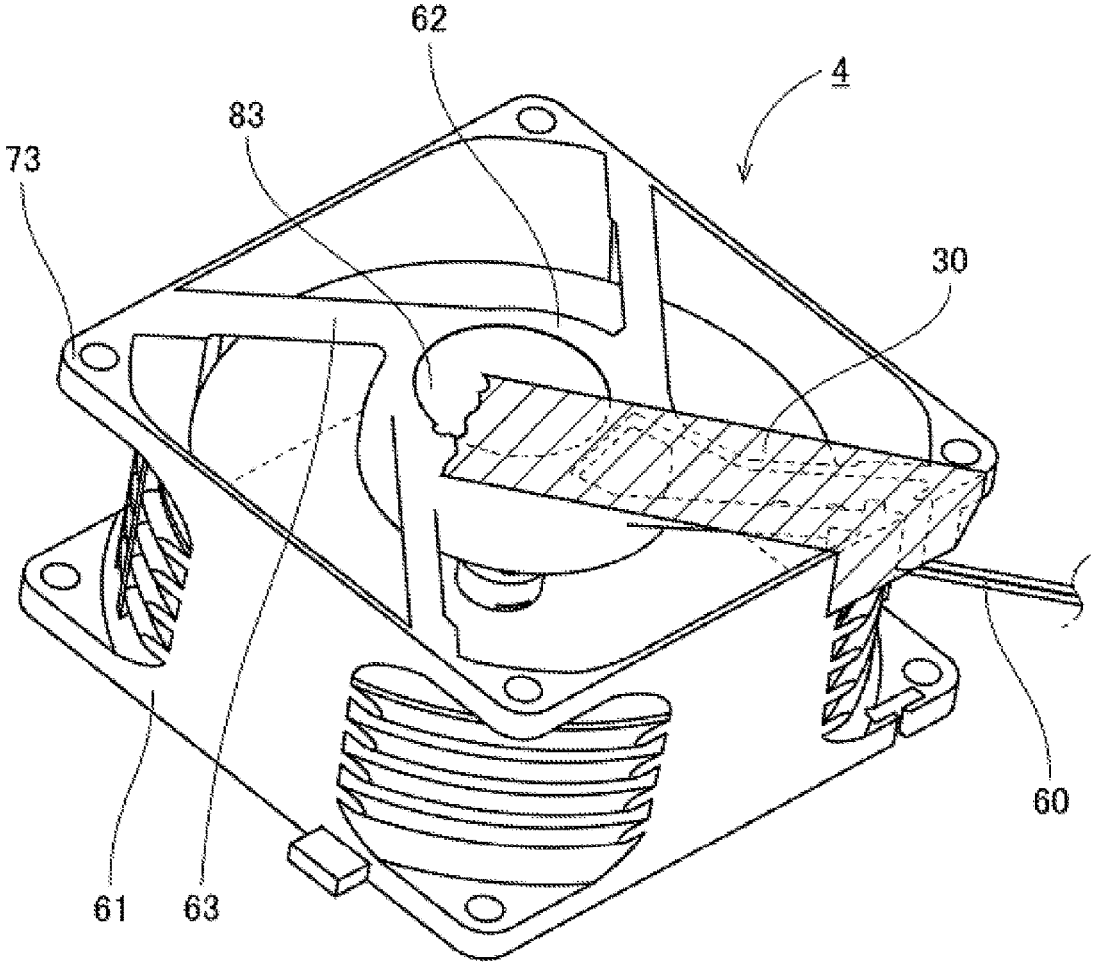
FIG. 5 is a perspective view of the housing according to a preferred embodiment of the present invention.
Figure 6:
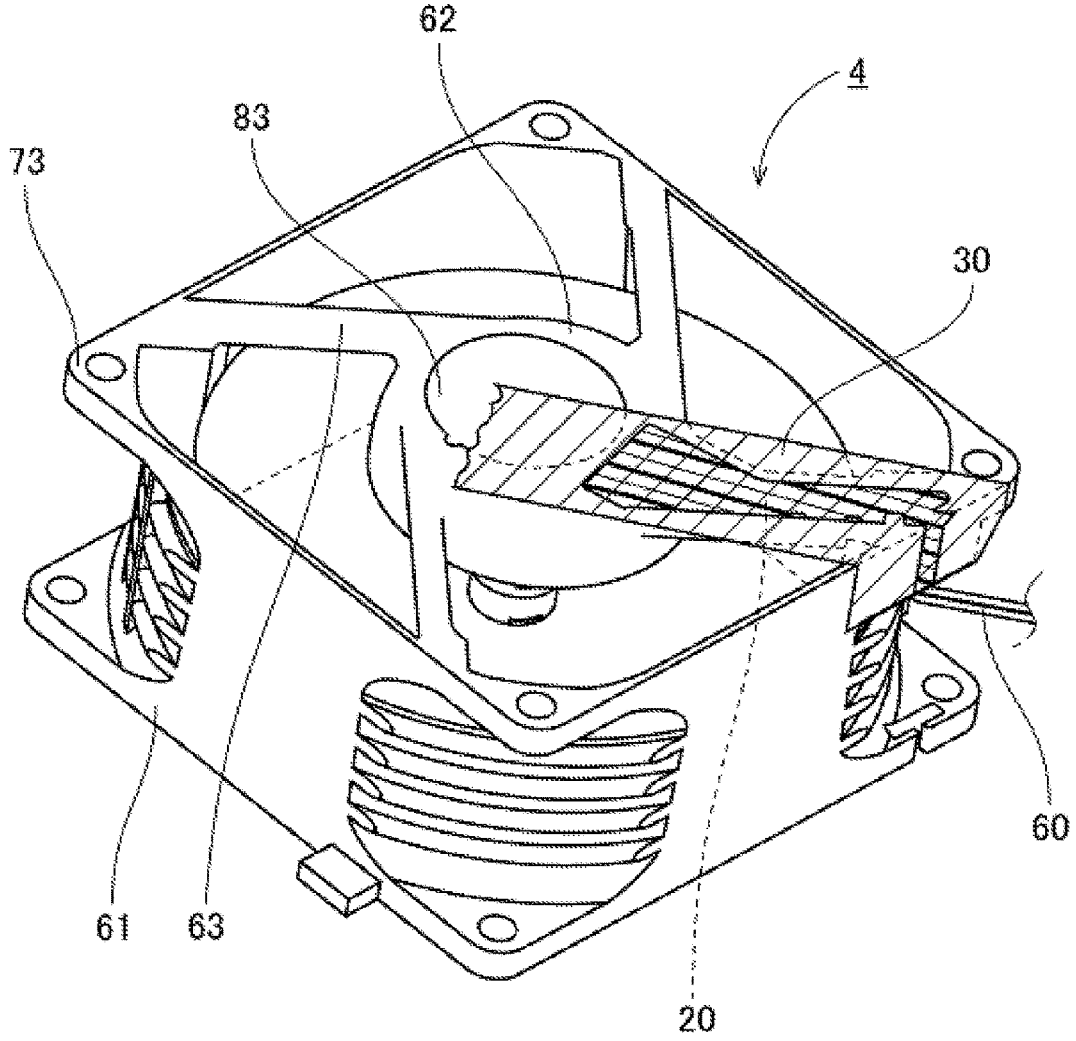
FIG. 6 is a perspective view of the housing according to a preferred embodiment of the present invention.
Figure 7:
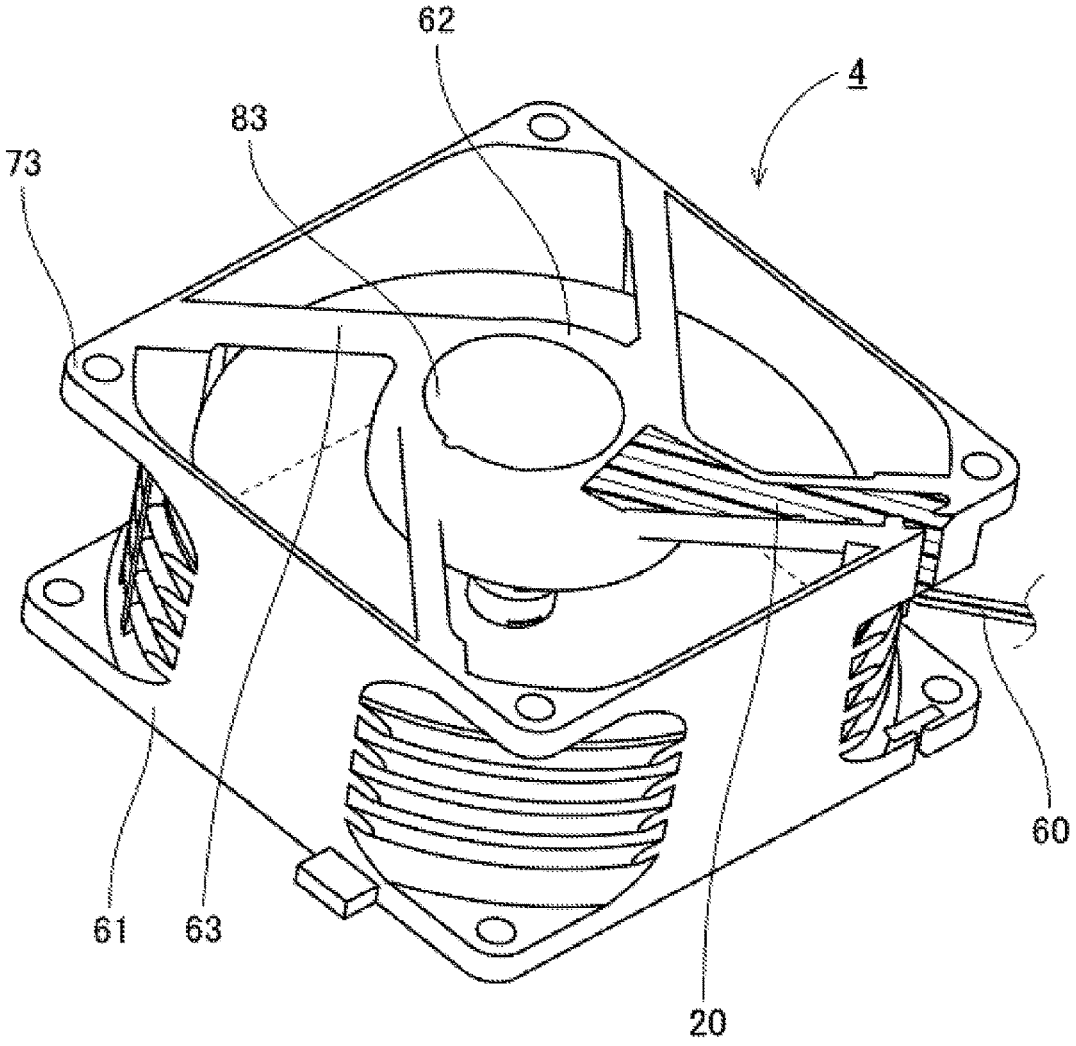
FIG. 7 is a perspective view of the housing according to a preferred embodiment of the present invention.

Next, with reference to FIGS. 5, 6, and 7, a process of arranging the thermosetting resin will now be described below. Each of FIGS. 5 to 7 is a perspective view of the housing 4 as viewed obliquely from below (i.e., from the outlet side of the fan motor 1). After the lead wires 60 are connected to the fan motor 1, the masking tape 30 is stuck to at least a portion of the lower surface of the bottom plate portion 62, at least a portion of the lower surface of the support portion 63, and at least a portion of each restricting portion 67 without a gap as illustrated in FIG. 5. A tape made of a resin, for example, is used as the masking tape 30. Both the groove portion 81 and the cut portion 82 are sealed with the masking tape 30. Here, if the cut portion 82 were not sufficiently sealed therewith, the thermosetting resin 20 might travel along the lead wires 60 due to capillary action and leak out beyond the cut portion 82 when the thermosetting resin 20 is poured. In the present preferred embodiment, however, each restricting portion 67 is arranged to have a sufficient area to allow the masking tape 30 to be stuck thereto. The cut portion 82 can therefore be sufficiently sealed with the masking tape 30.

Next, the thermosetting resin 20 in a liquid state is poured into the groove portion 81, in which the lead wires 60 are accommodated, from above (i.e., from the side on which the motor 2 is disposed) as illustrated in FIG. 6. Here, the thermosetting resin 20 is arranged not only in the groove portion 81 but also in at least a portion of the cut portion 82. That is, the thermosetting resin 20 is arranged to extend from the radially innermost end of the groove portion 81 in the vicinity of the junction of the groove portion 81 with the bottom plate portion 62 to the position radially outward of the projecting portion 681, which is the radially outermost one of the projecting portions 68, in the vicinity of the junction of the groove portion 81 with the tubular portion 61.

The thermosetting resin 20 arranged in the fan motor 1 is cured by heat. For example, dozens of fan motors 1 into which the thermosetting resin 20 in the liquid state has been poured are placed in a thermostat oven at a temperature of about 80° C. for several hours, so that the thermosetting resin 20 is cured and solidified. In this operation, the thermosetting resin 20 in the liquid state before being cured is sufficiently held without a leakage, because both the groove portion 81 and the cut portion 82 are sufficiently sealed. In addition, an unwanted external appearance of the fan motor does not occur.

After the thermosetting resin 20 arranged in the fan motor 1 is sufficiently cured, the masking tape 30, which has been used for the sealing, is removed from the fan motor 1, so that the thermosetting resin 20 solidified is exposed as illustrated in FIG. 7.

In this situation, the thermosetting resin 20 covers a range from the radially innermost end of the groove portion 81 in the vicinity of the junction of the groove portion 81 with the bottom plate portion 62 to the position radially outward of the projecting portion 681, which is the radially outermost one of the projecting portions 68, in the vicinity of the junction of the groove portion 81 with the tubular portion 61. The lead wires 60 are securely fixed to the fan motor 1 through the solidified thermosetting resin 20. In addition, the opening portion 64 is closed with the solidified thermosetting resin 20. This contributes to preventing intrusion of water toward the circuit board 65.

While preferred embodiments of the present invention have been described above, the present invention is not limited to the above-described preferred embodiments.

First, in the above-described preferred embodiment, the thermosetting resin 20 is arranged not only in the groove portion 81 but also in a portion of the cut portion 82. However, if at least the circuit board 65, which is arranged in the lower portion of the motor 2, and a junction of the circuit board 65 with each lead wire 60 are covered with the thermosetting resin to prevent intrusion of water, the fan motor 1 will be waterproof. Accordingly, if the thermosetting resin 20 is poured into the groove portion 81 at the vicinity of the junction of the groove portion 81 with the bottom plate portion 62, and the thermosetting resin 20 is allowed to reach the position of a relatively inward one of the projecting portions 68, required waterproof performance of the fan motor 1 can be achieved. Therefore, the thermosetting resin 20 may not necessarily be arranged to extend up to the cut portion 82.

Also, in the above-described preferred embodiment, the groove portion 81 is defined in only one of the four support portions 63. However, depending on the structure of the fan motor 1 or the structure of a device to which the fan motor 1 is attached, the groove portion 81 may be defined in each of two or more of the support portions 63, and the lead wires 60 may be arranged to extend in a plurality of directions to be drawn out of the fan motor 1. In this case, it is desirable that the size and depth of each of the groove portions 81 and the cut portions 82 be adjusted in accordance with the number of lead wires 60 and the width of each lead wire 60

Note that details of the shape of a fan motor according to a preferred embodiment of the present invention may differ from details of the shape of the fan motor as illustrated in the accompanying drawings of the present application. Also note that features of the above-described preferred embodiments and the modifications thereof may be combined appropriately as long as no conflict arises.

Preferred embodiments of the present invention are applicable to fan motors.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fan motor comprising:

a motor including a stationary portion and a rotating portion arranged to rotate about a rotation axis extending in a vertical direction;

an impeller including a plurality of blades, and arranged to rotate together with the rotating portion;

a housing arranged to house the motor and the impeller therein; and a lead wire electrically connected to the motor, and extending outwardly of the housing; wherein the housing includes:

a tubular portion that extends from an inlet side to an outlet side along the rotation axis, and houses at least a portion of the impeller therein;

a bottom plate portion fixed below the motor and radially inside of the tubular portion; and a support portion that extends from at least a portion of the tubular portion toward the bottom plate portion, and is joined to at least a portion of the bottom plate portion;

the support portion includes a groove portion recessed upward;

the tubular portion includes a cut portion defined at a radially outermost surface of the tubular portion and continuous with the groove portion;

the lead wire is drawn out of the housing through the groove portion and the cut portion; and the cut portion includes a thermosetting resin arranged therein at the radially outermost surface of the tubular portion.

2. The fan motor according to claim 1, wherein the thermosetting resin is also arranged in the groove portion.

3. The fan motor according to claim 2, wherein the support portion further includes a plurality of projecting portions each of which projects in a direction that crosses a longitudinal direction of the support portion in the groove portion; and at least a portion of the lead wire is accommodated in a space to a side of the projecting portions in the groove portion.

4. The fan motor according to claim 3, wherein the thermosetting resin extends from a radially innermost end of the groove portion to the radially outermost surface of the tubular portion.

5. The fan motor according to claim 3, wherein the radially outermost one of the projecting portions has a greatest axial dimension of all the projecting portions.

6. The fan motor according to claim 5, wherein the thermosetting resin extends from a radially innermost end of the groove portion to the radially outermost surface of the tubular portion.

7. The fan motor according to claim 3, wherein at least the portion of the lead wire which is accommodated in the space to the side of the projecting portions is coated with a heat-shrinkable tube.

8. The fan motor according to claim 1, wherein the support portion includes a tapered surface angled with respect to both axial and circumferential directions.

9. The fan motor according to claim 1, wherein the bottom plate portion includes a recessed portion defined in at least a portion of a lower surface thereof; and the recessed portion is spaced from an end portion of the bottom plate portion at a junction of the bottom plate portion with the support portion.

10. The fan motor according to claim 9, wherein at least a portion of the lower surface of the bottom plate portion is smoothly and continuously joined to at least a portion of a lower surface of the support portion.

11. The fan motor according to claim 1, wherein the housing includes a flange portion that projects radially outward from a lower end of the tubular portion, and restricting portions that extend in an axial direction on both circumferential sides of the cut portion; and each restricting portion has an axial dimension greater than an axial dimension of the flange portion.

12. The fan motor according to claim 1, wherein at least a portion of the lead wire is coated with a heat-shrinkable tube.

* * * * *